US005234280A

United States Patent [19]

Cowan

[11] Patent Number: 5,234,280

[45] Date of Patent: Aug. 10, 1993

[54] TRAFFIC CHANNELING DEVICES

[75] Inventor: David A. Cowan, Cleveland Hts., Ohio

[73] Assignee: Plastic Safety Systems, Inc., Cleveland, Ohio

[21] Appl. No.: 860,179

[22] Filed: Mar. 30, 1992

[51] Int. Cl.[5] ..... E01F 9/00; E01F 13/00

[52] U.S. Cl. ..... 404/6; 404/9; 248/910

[58] Field of Search ..... 404/6, 9; 256/1, 13.1; 248/548, 910, 520; 40/606, 612

[56] References Cited

U.S. PATENT DOCUMENTS 2,957,444 10/1960 Boettler .
3,451,368 6/1969 Keats ..... 404/9 X
3,475,009 10/1969 Brown .
3,848,853 11/1974 Way et al. .
4,157,210 6/1979 Mesman .
4,312,600 1/1982 Schaaf et al. ..... 404/9 X
4,710,053 12/1987 Kulp et al. ..... 404/6 X
5,156,486 10/1992 Davidson ..... 404/6 X

FOREIGN PATENT DOCUMENTS 2125863 3/1984 United Kingdom .

*Primary Examiner*—William P. Neuder
*Attorney, Agent, or Firm*—Renner, Otto, Boisselle & Sklar

[57] ABSTRACT

Traffic channeling device includes a deformable plastic drum and a rubber collar insertable over the drum to act as ballast for the drum. The rubber collar comprises a bead portion and an integral side wall portion of a recycled truck tire. When the rubber collar is inserted over the drum, the rubber collar gives the drum a relatively low center of gravity and grips the ground over a relatively large surface area to resist tipping of the drum and eliminate walking of the drum on the ground.

28 Claims, 3 Drawing Sheets

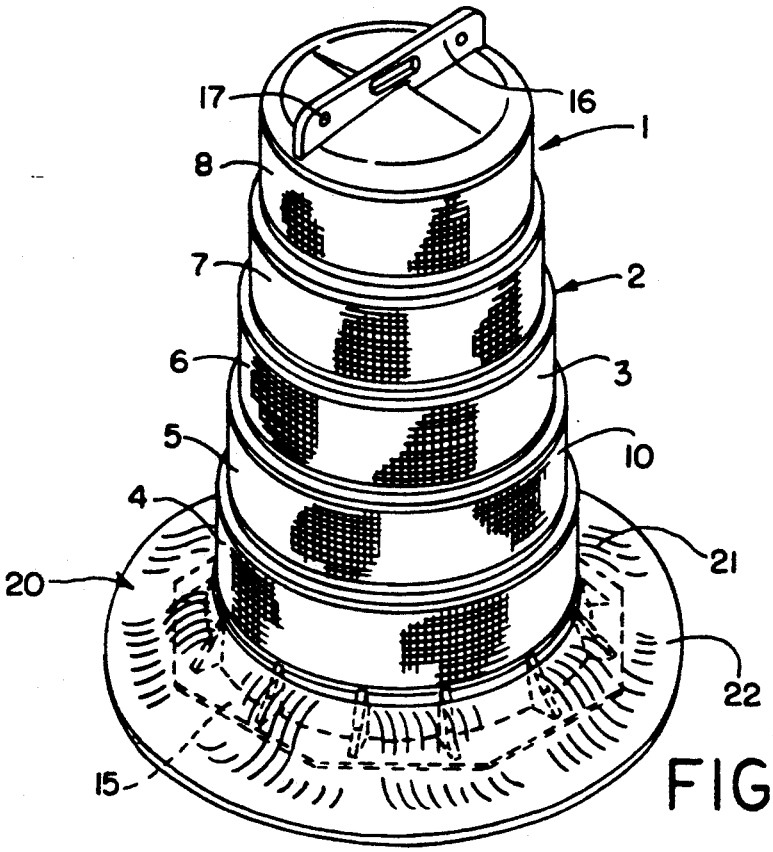
FIG. 1
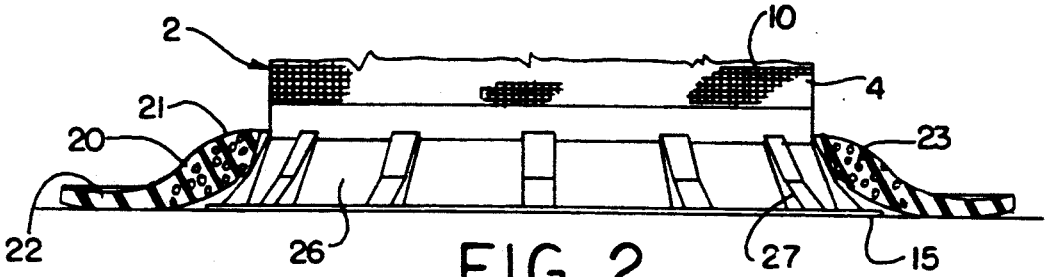
FIG. 2
FIG. 3
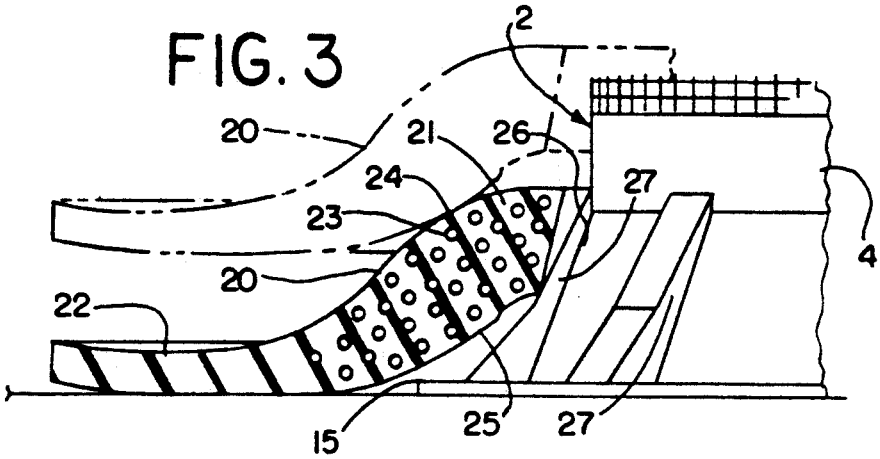

TRAFFIC CHANNELING DEVICES

FIELD OF THE INVENTION

This invention relates generally to traffic channeling devices for use in guiding and directing normal vehicle traffic around road and highway construction sites and the like.

BACKGROUND OF THE INVENTION

Many different types of traffic channeling devices have been utilized previously. One type that has been widely used comprises a hollow drum made of a relatively lightweight plastic material which will not cause damage to a vehicle if the vehicle should accidentally strike the drum.

Because such hollow plastic drums are relatively light in weight, some type of ballast is needed to prevent the drums from being inadvertently blown over or moved about by the wind and/or air blasts produced by passing vehicles. One common form of ballast consists of sandbags which may be placed against the base of the drums.

The problem with using sandbags as ballast is that many applications require at least two sandbags, each weighing between 35 and 50 pounds, to hold each drum in place. Not only is it necessary to fill the sandbags, the sandbags must be transported and positioned in place on the drums at the job site, which is backbreaking work because they are so heavy and significantly adds to the time and labor of setting up the drums. Also, sandbags are susceptible to breakage and the potential danger of spreading loose sand on the roadway.

Sand-filled plastic bases as well as sandbags placed on top of plastic bases have also been used as ballast for breakaway drums that fit over the bases. The problem with these is that the bases must either be filled with as much as 60 pounds of sand or sandbags must be placed against the bases to hold the drums in place, which makes them difficult to set up and install. Moreover, plastic bases have a tendency to walk or creep on the ground due to wind or vacuum caused by passing vehicles and the like. Also, an inspector cannot make a drive-by inspection to determine whether the drums that use sand-filled bases as ballast are properly ballasted. In addition, it is costly to produce breakaway drums that are not susceptible to being blown or dislodged from the bases by wind or vacuum of passing vehicles and yet will readily allow the drums to break away from the bases under impact by a vehicle. Even if the drums do properly break away only on impact, some damage may still result to the vehicle if the vehicle should drive over the sand-filled bases.

The use of heavy metal rings as ballast to hold traffic markers down and prevent them from being blown over is also generally known. However, metal rings must be quite heavy in order to give the markers the desired stability, which makes them difficult to handle and install. Moreover, there is still the danger that if one of the vehicles should drive over the metal rings, some damage to the vehicle may result.

SUMMARY OF THE INVENTION

The present invention provides traffic channeling devices that are more stable with less weight than previous devices of this type. Also, the devices are designed so as not to cause damage to a vehicle should the vehicle and/or any of its tires hit the devices or any portions thereof.

In accordance with one aspect of the invention, the devices comprise relatively lightweight, deformable plastic drums that are exteriorly ballasted by rubber collars, thus allowing drive-by inspection.

In accordance with another aspect of the invention, the rubber collars easily fit over the exterior of the drums for ease of installation.

In accordance with still another aspect of the invention, the rubber collars give the drums a relatively low center of gravity and grip the road over a relatively large surface area to resist tipping of the drums and eliminate "walking" of the drums on the ground which is common to plastic drums.

In accordance with still another aspect of the invention, the drums have a loose fit in the rubber collars which allows the drums to flex and vibrate under traffic and wind conditions without tipping over or moving laterally. If the drums should tip over, the loose fit of the collars allows the collars to move up on the drums, making it more difficult for the drums to roll on the ground.

In accordance with still another aspect of the invention, a stiffened skirt portion adjacent the bottom of the drums provides enough resistance to the removal of the drums from the rubber collars so that the drums cannot be blown or sucked out from the rubber collars by the wind or passing vehicles while still allowing the drums to distort and break away from the rubber collars upon impact of the drums by a vehicle, leaving the rubber collars in place. The drums are desirably made of either low or high density polyethylene. The advantage in using high density polyethylene is that it allows the drums to be made lighter than if low density polyethylene is used. However, low density polyethylene drums are more easily reshaped after impact than high density polyethylene drums. Also, the skirt portion of the drums desirably resist rolling of the drums on the ground when dislodged or otherwise removed from the rubber collars.

In accordance with yet another aspect of the invention, the rubber collars have a generally ramp-like shape, making it easy for a vehicle to drive over the collars without causing any damage to the vehicle after the drums have been dislodged from the rubber collars.

In accordance with another aspect of the invention, the rubber collars include a relatively rigid inner peripheral portion surrounding the drum skirt portion where most of the weight of the rubber collars is concentrated and a relatively flexible outer peripheral portion spaced radially outwardly from the drums in substantial surface contact with the ground for better gripping to resist tipping of the drums and eliminate walking of the drums along the ground. Also, the flexible outer peripheral portions of the rubber collars resist rolling of the drums in the event the drums are completely tipped over while the collars are still in place.

In accordance with still another aspect of the invention, the rubber collars are preferably made of recycled truck tires that are virtually indestructible, resulting in longer product life and lower replacement cost.

In accordance with still another aspect of the invention, the drums are preferably designed to be stacked with or without the rubber collars, which also nest for easy and safe storage. Moreover, the drums are designed to be easily pulled from the collars for fast and easy take-down.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings:

FIG. 1 is a perspective view of one form of traffic channeling device in accordance with the present invention;

FIG. 2 is a side elevation view of the bottom portion of the drum and transverse section through the rubber collar which comprise the traffic channeling device of FIG. 1;

FIG. 3 is an enlargement of the left-hand portion of the drum and rubber collar of FIG. 2, with a second rubber collar shown in phantom lines stacked on top of the first rubber collar;

DETAILED DESCRIPTION OF THE PREFERRED EMBODIMENTS

Figure 6:
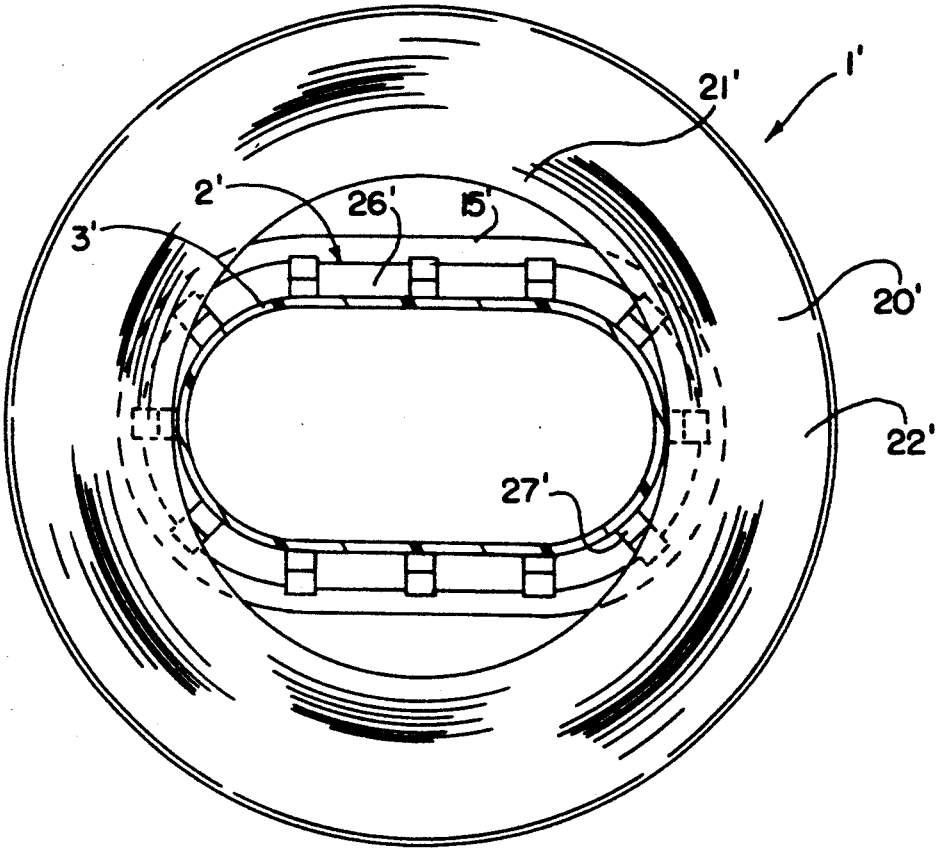
FIG. 6 is a transverse section through the drum portion of a slightly modified form of traffic channeling device in accordance with this invention.

Referring now in detail to the drawings, and initially to FIG. 1, one form of traffic channeling device in accordance with this invention is generally indicated by the reference numeral 1 and includes a relatively thin walled, hollow drum 2 which is desirably blow molded out of a relatively lightweight, deformable plastic material such as high or low density polyethylene. The side wall 3 or 3' of the drum may either be generally cylindrical in shape as shown in FIG. 1 or of a generally oval shape as shown in FIG. 6. In either case, the drum side wall 3 or 3' is desirably stepped radially inwardly at discrete intervals along the axial length of the drum from the bottom toward the top to facilitate stacking of the drums for easy handling and storage and to provide a plurality of axially spaced surfaces 4–8 which are desirably recessed to protect bands of reflective sheeting 10 applied to one or more of the surfaces against damage during stacking.

In the embodiment shown in FIG. 1, the drum 2 five such recessed surfaces 4–8 each having a height for example of approximately 6 to 6½ inches for accepting up to 5 bands of 6 inch reflective sheeting 10. Also, each recessed surface is desirably approximately ¾ of an inch less in diameter than the preceding recessed surface from bottom to top, with the lowermost recessed surface having an outer diameter for example of between approximately 21 inches and 21¼ inches and the uppermost recessed surface having an outer diameter for example of between approximately 18 inches and 18¼ inches.

The traffic channeling device 1' shown in FIG. 6 is desirably substantially the same as that shown in FIG. 1 except that the drum side wall 3' and corresponding recessed surfaces are generally oval in shape. Accordingly, the same reference numerals followed by a prime symbol (') are used to designate like parts.

An advantage in making each of the recessed surfaces generally oval shape is that if the maximum dimension of each oval surface is the same as the cylindrical recessed surfaces shown in FIG. 1, the overall circumference of each recessed surface would be reduced, thus reducing the amount of reflective sheeting to be applied thereto, which is costly.

Another advantage in making the drum generally oval shape or other noncylindrical shape such as hexagonal shape is that if the drum is tipped over, it will not roll as easily as would a generally cylindrical drum. However, providing a multi-faceted flange 15 on the bottom of the cylindrical drum 2 as shown in FIG. 1 also minimizes rolling.

Protruding axially outwardly from the top of the drum 2 is an integrally molded handle 16 to facilitate carrying of the drum from one location to another. Also, suitable mounting holes 17 may be provided in the handle 16 for attachment of standard warning devices thereto.

Blow molding the drums 2 out of a relatively lightweight, deformable plastic material such as high or low density polyethylene has the advantage that the drums are virtually indestructible, resulting in longer product life and lower replacement cost. Making the drums out of high density polyethylene has the further advantage that they can be made lighter than low density polyethylene drums. However, low density polyethylene drums are more easily reshaped after impact than high density polyethylene drums. In either case, the drums are impervious to moisture, ultraviolet rays and temperature extremes. Moreover, polyethylene is a Class 2 recyclable plastic, whereby if any of the drums should become sufficiently damaged to require replacement, the drums can be recycled.

The drums themselves are relatively light in weight, preferably weighing between approximately 7½ and 9 pounds. To prevent the drums from being blown over or inadvertently moved about by the wind and/or air currents produced by passing vehicles, the drums are ballasted in accordance with this invention by placing one or more rubber collars 20 over the exterior of the drums. Preferably the rubber collars 20 are 100% recycled from worn out truck tires, and are virtually indestructible. Moreover, the collars, like the drums, are impervious to moisture, U.V. rays, and temperature extremes.

In the preferred embodiment disclosed herein, each rubber collar 20 comprises one of the beads 21 and an integral portion 22 of the side wall of a worn out 11×22.5 steel belted radial tubeless truck tire which has an inner diameter of approximately 21¾ inches, leaving approximately a ½ inch to ¾ inch diametrical clearance between the collar bead 21 and the 21 inch to 21¼ inch outer diameter of the lowermost cylindrical recessed surface 4 of the drum 2 when inserted thereover as schematically shown in FIGS. 2 and 3. Also when the rubber collar is inserted over the drum as shown in these figures, the rubber collar desirably has a maximum height at the inner periphery of the bead 21 of approximately 3 inches and an outer diameter of approximately 36½ inches. Moreover, the side wall portion 22 of the rubber collar desirably makes substantially flat contact with the ground over a radial distance of approximately 2½ inches around the entire outer periphery of the collar.

The tire bead 21, which constitutes the inner peripheral portion of the rubber collar 20, is reinforced by steel wires 23 (see FIGS. 2-5), making it much more rigid and heavier than the side wall portion 22 which is made of a relatively soft, non-rigid rubber. During installation, the rubber collar 20 is simply dropped over the drum 2 with the convex side 24 of the bead 21 facing upwardly (i.e., toward the top of the drum) and the concave side 25 of the bead facing downwardly (i.e., toward the bottom of the drum) as schematically shown in FIG. 3.

To resist pullout of the drum 2 from the rubber collar 20, a radially outwardly tapering skirt portion 26 is provided adjacent the bottom of the drum. In the preferred embodiment disclosed herein, the skirt portion 26 desirably has a wall thickness of approximately 1/16 inch and an overall height of approximately 2¾ inches. Also, the skirt portion desirably tapers outwardly from the lowermost recessed surface 4 at an angle of approximately 20° to a maximum outer diameter of approximately 23 inches. At the bottommost edge of the skirt portion 26 is the multi-faceted flange 15 which desirably has a maximum outer dimension of approximately 26 inches.

To increase the stiffness of the skirt portion 26 and flange 15 so that the drum 2 cannot be blown or suctioned out from the rubber collar 20 by the wind or the vacuum produced by passing cars and trucks while still allowing the drum to collapse sufficiently to break away from the rubber collar upon impact by a vehicle, a plurality of circumferentially spaced stiffening ribs 27 are desirably integrally formed with the skirt portion and flange. In the embodiment disclosed herein, 12 such stiffening ribs 27 are provided equally spaced around the periphery of the skirt portion 26 and flange 15. Each rib desirably has a width of approximately 1¼ inches and a maximum radial dimension at the bottom of approximately ⅞ inch. Also, the ribs desirably have an overall height of approximately 3 inches and a wall thickness of approximately 3/32 inch. Preferably, the ribs initially extend radially downwardly and outwardly at an angle of approximately 25° for approximately 1¾ inches of their height and then radially outwardly and downwardly at an angle of approximately 40° for the remaining 1¼ inches of their height.

Providing such a ribbed skirt portion 26 and flange 15 at the bottom of the drum 2 still allows the drum 2 to collapse sufficiently to break away from the rubber collar 20 when the drum is hit by a vehicle, leaving the rubber collar, which constitutes most of the weight of the traffic channeling device 1, in place. A typical drum 2 made in accordance with the present invention weighs between approximately 7½ and 9 pounds, whereas the rubber collar 20 weighs approximately 25 pounds. Such a breakaway connection between the rubber collar and drum also permits the drum to be pulled from the rubber collar for fast and easy take-down when desired.

Figure 5:
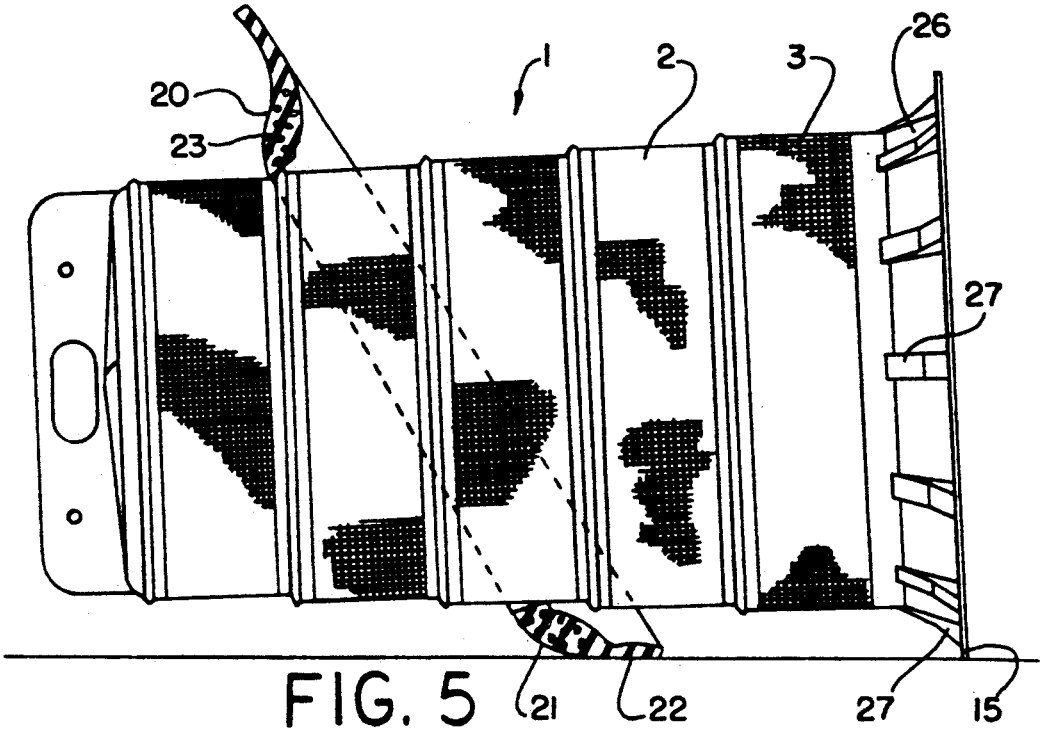
FIG. 5 is a side elevation view, partly in section, similar to FIG. 4 but showing the traffic channeling device completely tipped over.

The loose fit between the drum 2 and rubber collar 20, in addition to aiding in dropping the rubber collar over the drum, allows the drum to flex and vibrate under traffic and wind conditions without tipping over or moving laterally. If perchance the drum should tip over, the loose fit also allows the rubber collar to move up on the drum and the relatively soft, non-rigid portion of the side wall 22 to flatten out where it contacts the ground as schematically shown in FIG. 5, making it more difficult for the drum to roll on the ground.

Figure 4:
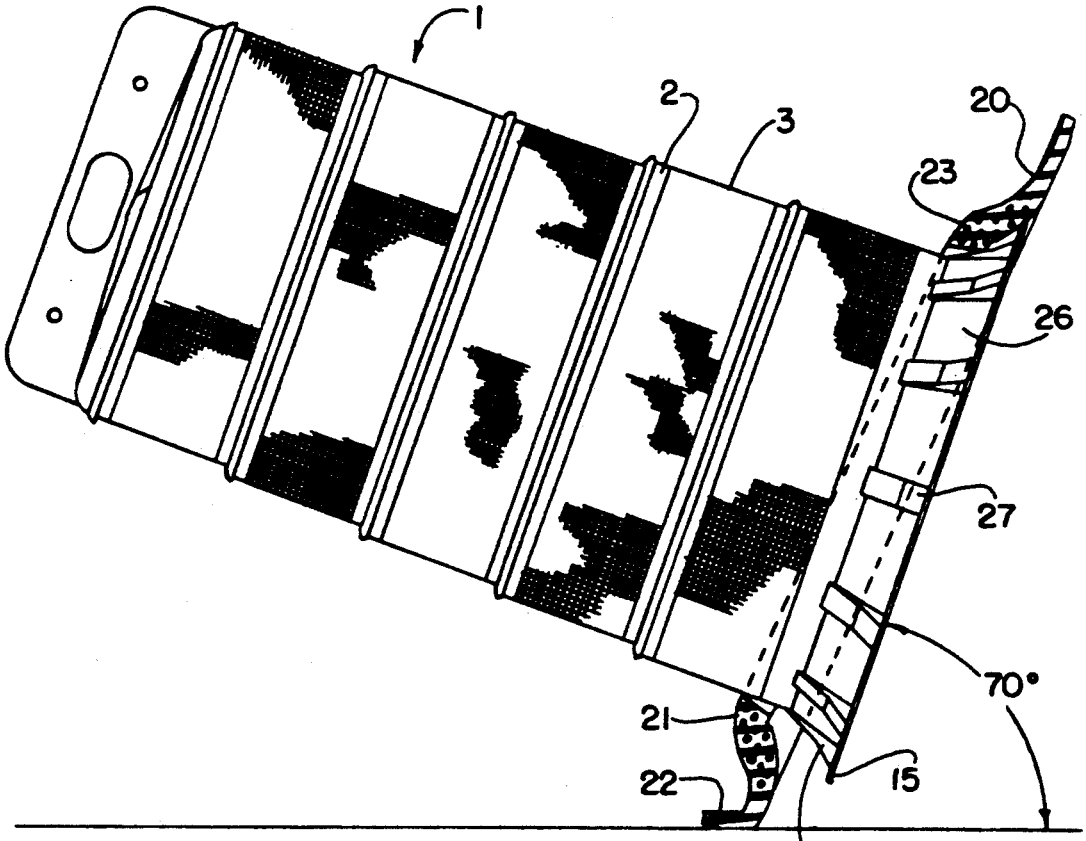
FIG. 4 is a side elevation view, partly in section, showing the traffic channeling device of FIG. 1 partially tipped over.

Using a rubber collar 20 constructed in accordance with the present invention as the ballast for the drum 2 has the further advantage that the outer periphery of the rubber collar will grip the roadway and eliminate "walking" of the drum on the ground, which is a condition common to plastic drums. The wider the collar, the greater the surface contact between the collar and roadway to eliminate "walking". Also, a wider collar gives a lower center of gravity to the drum as it is tipped up, causing the drum to revert to vertical over a much wider angle of inclination, for example, up to 70° from vertical as schematically shown in FIG. 4. If the drum should completely tip over as schematically shown in FIG. 5, the riding up of the collar on the drum and the tendency of the relatively soft, non-rigid outer peripheral portion 22 of the collar to flatten out against the ground make it more difficult for the drum to roll.

Once the drum 2 breaks away from the rubber collar 20 upon impact, the rubber collar will substantially remain in place on the ground and thus will no longer provide any resistance to rolling of the drum. However, providing the drum with an oval shape as shown in FIG. 6 or a multi-faceted flange 15 such as the hexagonal shape flange shown in FIG. I will minimize rolling of the drum when dislodged from the rubber collar upon impact. Also, the generally ramp-like shape of the rubber collar 20 (see FIGS. 2 and 3) makes it easy for a vehicle to drive over the collar without causing damage to the vehicle after the drum has been dislodged from the collar upon impact.

Under most traffic and weather conditions, a single 25 pound rubber collar 20 is all the ballast that is needed to hold each drum 2 made in accordance with the present invention in place. The combined weight of the drum 2 and ballast (rubber collar) 20 of the present invention is far less than any competing product and yet such a traffic channeling device 1 is more stable, less likely to tip over, and eliminates the "walking" problems associated with other traffic channeling devices. Moreover, because of the modular nature of the rubber collars 20, two or more such collars may be placed over a single drum 2, one on top of the other as schematically shown in phantom lines in FIG. 2 to add additional ballast as needed.

From the foregoing, it will be apparent that the drums of the present invention may readily be stacked one on top of the other with or without the rubber collars in place over the drums for ease of storage and shipment. The rubber collars themselves will nest one on top of the other for easy and safe storage. Moreover, the drums may easily be set up by dropping the rubber collars over the drums while still on a truck so they are ready to install at the job site.

The exterior ballasting of the drums by the rubber collars also allows drive-by inspection. Moreover, the rubber collars grip the ground thus eliminating walking of the drums. In addition, the breakaway connection between the drums and rubber collars not only allows the drums to be dislodged from the collars upon impact, but also allows the drums to be pulled from the collars for fast and easy take-down.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. A traffic channeling device comprising a deformable hollow plastic drum, and rubber collar means adapted to be inserted over said drum to act as ballast for said drum, said drum having a radially outwardly and axially downwardly tapering skirt portion adjacent a bottom edge of said drum for resisting pullout of said drum from said rubber collar means.

2. The traffic channeling device of claim 1 further comprising integral flange means extending radially outwardly from said skirt portion.

3. The traffic channeling device of claim 2 further comprising stiffening ribs integral with said skirt portion and said flange means.

4. The traffic channeling device of claim 3 wherein said stiffening ribs initially extend downwardly and outwardly at an angle of approximately 25° for a portion of their height and then downwardly and outwardly at an angle of approximately 40° for the remaining portion of their height.

5. The traffic channeling device of claim 3 wherein said skirt portion extends downwardly and outwardly adjacent said bottom edge of said drum at an angle of approximately 20°.

6. The traffic channeling device of claim 1 wherein said rubber collar means comprises a relatively rigid bead portion and a relatively non-rigid integral side wall portion of a recycled truck tire.

7. The traffic channeling device of claim 6 wherein said bead portion of said rubber collar means has an inner periphery defining an opening through which said drum extends up to said skirt portion, and said side wall portion of said rubber collar means extends radially outwardly and axially downwardly from said bead portion for substantial flat engagement with a surface on which said drum is placed.

8. The traffic channeling device of claim 7 wherein said inner periphery of said bead portion has a diameter greater than the maximum transverse dimension of said drum adjacent an upper end of said skirt portion and less than the maximum transverse dimension of said skirt portion.

9. The traffic channeling device of claim 8 wherein said drum is deformable upon impact by a vehicle to cause said drum to become dislodged from said rubber collar means leaving said rubber collar means behind.

10. The traffic channeling device of claim 9 wherein said drum is made of a high or low density polyethylene.

11. The traffic channeling device of claim 1 wherein said collar means has a loose fit on said drum to allow said drum to flex and vibrate under traffic and wind conditions without tipping over.

12. The traffic channeling device of claim 1 wherein said drum is generally oval shape to minimizes rolling of said drum when tipped over.

13. The traffic channeling device of claim 1 wherein a plurality of said rubber collar means are adapted to be inserted over said drum in stacked relation to act as ballast for said drum.

14. The traffic channeling device comprising a deformable hollow plastic drum, and rubber collar means insertable over said drum to act as ballast for said drum, said rubber collar means comprising a bead portion and an integral side wall portion of a recycled truck tire, said bead portion having an inner periphery defining an opening through which said drum extends, and said side wall portion extends radially outwardly and axially downwardly from said bead portion for substantial flat engagement with a surface on which said drum is placed.

15. The traffic channeling device of claim 14 further comprising means adjacent a bottom edge of said drum for resisting pullout of said drum from said rubber collar means, said drum being deformable upon impact by a vehicle to cause said drum to become dislodged from said behind.

16. The traffic channeling device of claim 15 wherein said rubber collar means has a loose fit on said drum to allow said drum to flex and vibrate under traffic and wind conditions without tipping over.

17. The traffic channeling device of claim 14 wherein said bead portion of said rubber collar means is thicker than said side wall portion and includes steel reinforcing, whereby said bead portion is heavier and more rigid than said side wall portion.

18. The traffic channeling device of claim 17 wherein said drum is deformable upon impact by a vehicle to cause said drum to become dislodged from said rubber collar means, said rubber collar means having a generally ramp-like shape making it easy for a vehicle to drive over said rubber collar means without causing damage to the vehicle after said drum has been dislodged from said rubber collar means upon impact.

19. The traffic channeling device of claim 17 wherein said rubber collar means has a loose fit over said drum, whereby in the event said drum should tip over, said rubber collar means will move up on said drum and said side wall portion will flatten but where said side wall portion contacts said surface, making it more difficult for said drum to roll.

20. A traffic channeling device comprising a deformable hollow plastic drum, and rubber collar means adapted to be inserted over said drum to act as ballast for said drum, said rubber collar means comprising a relatively rigid bead portion and a relatively non-rigid integral side wall portion of a recycled truck tire.

21. The traffic channeling device of claim 20 wherein said bead portion of said rubber collar means has an inner periphery defining an opening for insertion of said rubber collar means over said drum.

22. The traffic channeling device of claim 20 further comprising means for resisting pull out of said drum from said rubber collar means.

23. The traffic channeling device of claim 20 wherein said rubber collar means has a loose fit on said drum, whereby in the event said drum should tip over, said rubber collar means will move up on said drum and said side wall portion will flatten out where said side wall portion contacts said surface, making it more difficult for said drum to roll.

24. The traffic channeling device of claim 20 wherein said drum is generally cylindrical in shape and has a multi-faceted flange extending radially outwardly from said skirt portion to minimize rolling of said drum when tipped over.

25. The traffic channeling device of claim 20 wherein said drum is stepped radially inwardly at discrete intervals along the axial length of said drum from bottom to top to facilitate stacking of said drums.

26. The traffic channeling device of claim 14 wherein said drum includes a plurality of recessed surfaces to protect bands of reflective sheeting applied to one or more of said recessed surfaces against damage during stacking of said drums.

27. The traffic channeling device of claim 20 wherein said bead portion of said rubber collar means includes steel reinforcing, whereby said bead portion is heavier and more rigid than said side wall portion.

28. The traffic channeling device of claim 20 wherein said drum is deformable upon impact by a vehicle to cause said drum to become dislodged from said rubber collar means, said rubber collar means having a generally ramp-like shape making it easy for a vehicle to drive over said rubber collar means without causing damage to the vehicle after said drum has been dislodged from said rubber collar means upon impact.

* * * * *

US005234280A

REEXAMINATION CERTIFICATE (2452nd)

United States Patent [19]

[11] B1 5,234,280

Cowan

[45] Certificate Issued Jan. 10, 1995

[54] TRAFFIC CHANNELING DEVICES

[75] Inventor: David A. Cowan, Cleveland Hts., Ohio

[73] Assignee: Plastic Safety Systems, Inc., Cleveland, Ohio

Reexamination Request:
No. 90/003,397, Apr. 5, 1994

Reexamination Certificate for:

| | |
|---|---|
| Patent No.: | **5,234,280** |
| Issued: | **Aug. 10, 1993** |
| Appl. No.: | **860,179** |
| Filed: | **Mar. 30, 1992** |

[51] Int. Cl.[6] ..... E01F 9/00; E01F 13/00

[52] U.S. Cl. ..... 404/6; 404/9; 248/910

[58] Field of Search ..... 404/6, 9; 256/1, 13.1; 248/548, 910, 500; 40/606, 612

[56] References Cited

U.S. PATENT DOCUMENTS

| | | | |
|---|---|---|---|
| D. 276,142 | 10/1984 | Dobrin | D10/106 |
| D. 309,585 | 7/1990 | Kulp | D10/113 |
| 2,957,444 | 10/1960 | Boettler | 116/63 |
| 3,475,009 | 10/1969 | Brown | 256/64 |
| 3,541,368 | 6/1969 | Keats | 404/9 X |
| 3,692,281 | 9/1972 | Clayton | 256/64 |
| 3,848,853 | 11/1974 | Way et al. | 256/1 |
| 3,952,690 | 4/1976 | Rizzo et al. | 116/63 P |
| 4,021,020 | 5/1977 | Decker | 256/1 |
| 4,083,033 | 4/1978 | Kulp et al. | 340/114 R |
| 4,157,210 | 6/1979 | Mesman | 350/97 |
| 4,312,600 | 1/1982 | Schaaf et al. | 404/6 |
| 4,710,053 | 12/1987 | Kulp et al. | 404/9 |
| 4,925,334 | 5/1990 | Beard | 404/9 |
| 5,026,204 | 6/1991 | Kulp et al. | 404/10 |
| 5,036,791 | 8/1991 | Thurston | 116/63 C |
| 5,156,486 | 10/1992 | Davidson | 404/10 |
| 5,199,813 | 4/1993 | Nagler | 404/9 |

FOREIGN PATENT DOCUMENTS

| | | |
|---|---|---|
| 2615541 | 11/1988 | France . |
| 2125863 | 3/1984 | United Kingdom . |
| 2122239A | 11/1984 | United Kingdom . |

OTHER PUBLICATIONS

Plastic Safety Systems, Inc., undated literature on "Plastic Safety Drum", 2 pages; references D276,142 (item AJ above).

Plastic Safety Systems, Inc. "Lifegard" Channelizer; 2 pages undated but bears 1992 copyright notice.

Plastic Safety Systems, Inc. undated, "Attention!" label as to use of 1 and 2 ballasting collars.

State of Tennessee—Plastic Safety Systems, Inc. Correspondence re Lifegard channelizer dated Sep. 11, 1992.

Province of Ontario—Plastic Safety Systems, Inc. Correspondence re "Lifegard" dated Jul. 13, 1992.

Iowa Dept. of Transportation, Supplemental Specification for Drums, dated Dec. 20, 1988.

August 1989 state of Wisconsin specifications for safety drums, and cones, 2 sheets, Wisdot Purchasing.

Plastic Safety Systems, Inc. literature "How Lifegard Saves Lives" undated, 1 sheet.

Indiana Dept. of Transportation letter of Feb. 1, 1994 contract provisions for use of "External Ballast Rubber Tire Base" (collars) by F. S. Vukovits.

Plastic Safety Systems, Inc. literature (undated) on Lifegard channelizer showing 2 nested collars.

Plastic Safety Systems, Inc. literature (undated) "Summary of stabilization Characteristic Testing". (two collars for the Lifegard).

Plastic Safety Systems, Inc. literature (undated) "Summary of Lifegard Testing completed by Independent Agencies".

*Primary Examiner*—William P. Neuder

[57] ABSTRACT

Traffic channeling device includes a deformable plastic drum and a rubber collar insertable over the drum to act as ballast for the drum. The rubber collar comprises a bead portion and an integral side wall portion of a recycled truck tire. When the rubber collar is inserted over the drum, the rubber collar gives the drum a relatively low center of gravity and grips the ground over a relatively large surface area to resist tipping of the drum and eliminate walking of the drum on the ground.

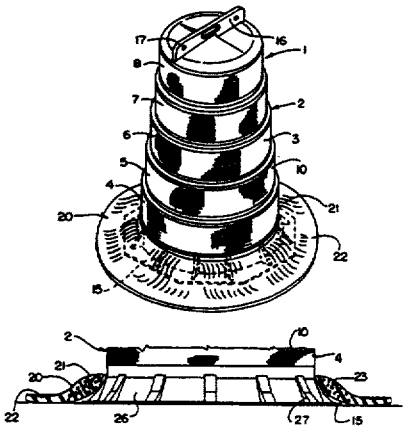

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the parent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 57–68:

In the embodiment shown in FIG. 1, the drum 2 *includes* five such recessed surfaces 4–8 each having a height for example of approximately 6 to 6½ inches for accepting up to 5 bands of 6 inch reflective sheeting 10. Also, each recessed surface is desirably approxmately ¾ of an inch less in diameter than the preceding recessed surface from bottom to top, with the lowermost recessed surface having an outer diameter for example of between approximately 21 inches and 21¼ and the uppermost recessed surface having an outer diameter for example of between approximately 18 inches and 18¼ inches.

AS A RESULT OF REEXAMINATION, IT HAS BEEN DETERMINED THAT:

Claim 9 is cancelled.

Claims 1, 10, 11, 14, 15, 18, 19, 20, 23 and 28 are determined to be patentable as amended.

Claims 2–8, 12, 13, 16, 17, 21, 22 and 24–27, dependent on an amended claim, are determined to be patentable.

New claims 29–32 are added and determined to be patentable.

1. A traffic channeling device comprising a deformable hollow plastic drum, and rubber collar means adapted to be inserted over said drum to act as ballast for said drum, said drum having a radially outwardly and axially downwardly tapering skirt portion adjacent a bottom edge of said drum for resisting pullout of said drum from said rubber collar means, *said drum being deformable upon impact by a vehicle to cause said drum to become dislodged from said rubber collar means leaving said rubber collar means behind.*

10. The traffic channeling device of claim [9] *1* wherein said drum is made of a high or low density polyethylene.

11. [The traffic channeling device of claim 1 wherein] *A traffic channeling device comprising a deformable hollow plastic drum, and rubber collar means adapted to be inserted over said drum to act as ballast for said drum, said drum having a radially outwardly and axially downwardly tapering skirt portion adjacent a bottom edge of said drum for resisting pullout of said drum from said rubber collar means,* said collar means [has] *having* a loose fit on said drum to allow said drum to flex and vibrate under traffic and wind conditions without tipping over.

14. [The] *A* traffic channeling device comprising a deformable hollow plastic drum, and rubber collar means insertable over said drum to act as ballast for said drum, said rubber collar means comprising a bead portion and an integral side wall portion of a recycled truck tire, said bead portion having an inner periphery defining an opening through which said drum extends, and said side wall portion extends radially outwardly and axially downwardly from said bead portion for substantial flat engagement with a surface on which said drum is placed, *said drum being deformable upon impact by a vehicle to cause said drum to become dislodged from said rubber collar means leaving said rubber collar means behind.*

15. [The traffic channeling device of claim 14 further comprising] *A traffic channeling device comprising a deformable hollow plastic drum, rubber collar means insertable over said drum to act as ballast for said drum, said rubber collar means comprising a bead portion and an integral side wall portion of a recycled truck tire, said bead portion having an inner periphery defining an opening through which said drum extends, and said side wall portion extends radially outwardly and axially downwardly from said bead portion for substantial flat engagement with a surface on which said drum is placed, and* means adjacent a bottom edge of said drum for resisting pullout of said drum from said rubber collar means, said drum being deformable upon impact by a vehicle to cause said drum to become dislodged from said *rubber collar means leaving said rubber collar means* behind.

18. [The traffic channeling device of claim 17 wherein] *A traffic channeling device comprising a deformable hollow plastic drum, and rubber collar means insertable over said drum to act as ballast for said drum, said rubber collar means comprising a bead portion and an integral side wall portion of a recycled truck tire, said bead portion having an inner periphery defining an opening through which said drum extends, and said side wall portion extends radially outwardly and axially downwardly from said bead portion for substantial flat engagement with a surface on which said drum is placed, said bead portion of said rubber collar means being thicker than said side wall portion and including steel reinforcing, whereby said bead portion is heavier and more rigid than said side wall portion,* said drum [is] *being* deformable upon impact by a vehicle to cause said drum to become dislodged from said rubber collar means, said rubber collar means having a generally ramp-like shape making it easy for a vehicle to drive over said rubber collar means without causing damage to the vehicle after said drum has been dislodged from said rubber collar means upon impact.

19. [The traffic channeling device of claim 17 wherein] *A traffic channeling device comprising a deformable hollow plastic drum, and rubber collar means insertable over said drum to act as ballast for said drum, said rubber collar means comprising a bead portion and an integral side wall portion of a recycled truck tire, said bead portion having an inner periphery defining an opening through which said drum extends, and said side wall portion extends radially outwardly and axially downwardly from said bead portion for substantial flat engagement with a surface on which said drum is placed, said bead portion of said rubber collar means being thicker than said side wall portion and including steel reinforcing, whereby said bead portion is heavier and more rigid than said side*

*wall portion,* said rubber collar means [has] *having* a loose fit over said drum, whereby in the event said drum should tip over, said rubber collar means will move up on said drum and said side wall portion will flatten [but] *out* where said side wall portion contacts said surface, making it more difficult for said drum to roll.

20. A traffic channeling device comprising a deformable hollow plastic drum, and rubber collar means adapted to be inserted over said drum to act as ballast for said drum, said rubber collar means comprising a relatively rigid bead portion and a relatively non-rigid integral side wall portion of a recycled truck tire, *said drum being deformable upon impact by a vehicle to cause said drum to be dislodged from said rubber collar means leaving said rubber collar means behind.*

23. [The traffic channeling device of claim 20 wherein] *A traffic channeling device comprising a deformable hollow plastic drum, and rubber collar means adapted to be inserted over said drum to act as ballast for said drum, said rubber collar means comprising a relatively rigid bead portion and a relatively non-rigid integral side wall portion of a recycled truck tire,* said rubber collar means [has] *having* a loose fit on said drum, whereby in the event said drum should tip over, said rubber collar means will move up on said drum and said side wall portion will flatten out where said side wall portion contacts said surface, making it more difficult for said drum to roll.

28. [The traffic channeling device of claim 20 wherein] *A traffic channeling device comprising a deformable hollow plastic drum, and rubber collar means adapted to be inserted over said drum to act as ballast for said drum, said rubber collar means comprising a relatively rigid bead portion and a relatively non-rigid integral side wall portion of a recycled truck tire,* said drum [is] *being* deformable upon impact by a vehicle to cause said drum to become dislodged from said rubber collar means, said rubber collar means having a generally ramp-like shape making it easy for a vehicle to drive over said rubber collar means without causing damage to the vehicle after said drum has been dislodged from said rubber collar means upon impact.

*29. A traffic channeling device comprising a deformable hollow plastic drum, and rubber collar means adapted to be inserted over said drum to act as ballast for said drum, said drum having a projecting portion adjacent a bottom edge of said drum for resisting pullout of said drum from said rubber collar means, said drum being deformable upon impact by a vehicle to cause said drum to become dislodged from said rubber collar means leaving said rubber collar means behind.*

*30. The traffic channeling device of claim 29 wherein said rubber collar means comprises a bead portion and an integral side wall portion of a recycled truck tire, said bead portion having an inner periphery defining an opening through which said drum extends, and said side wall portion extending radially outwardly and axially downwardly from said bead portion for substantial flat engagement with the surface on which said drum is placed.*

*31. The traffic channeling device of claim 30 wherein said rubber collar means has a generally ramp-like shape making it easy for a vehicle to drive over said rubber collar means without causing damage to the vehicle after said drum has been dislodged from said rubber collar means upon impact.*

*32. The traffic channeling device of claim 29 wherein said rubber collar means has a loose fit on said drum.*

* * * * *

US005234280B1

REEXAMINATION CERTIFICATE (3394th)

United States Patent [19] [11] B2 5,234,280

Cowan [45] Certificate Issued Dec. 9, 1997

[54] TRAFFIC CHANNELING DEVICES

[75] Inventor: David A. Cowan, Cleveland Hts., Ohio

[73] Assignee: Plastic Safety Systems, Inc., Cleveland, Ohio

Reexamination Request:
No. 90/004,535, Jan. 31, 1997

Reexamination Certificate for:

| | |
|---|---|
| Patent No.: | **5,234,280** |
| Issued: | **Aug. 10, 1993** |
| Appl. No.: | **860,179** |
| Filed: | **Mar. 30, 1992** |

Reexamination Certificate B1 5,234,280 issued Jan. 10, 1995

[51] Int. Cl.[6] ..... E01F 9/00; E01F 13/00

[52] U.S. Cl. ..... 404/6; 248/910; 404/9

[56] References Cited

U.S. PATENT DOCUMENTS

D. 276,142 10/1984 Dobrin .
D. 309,585 7/1990 Kulp .
2,957,444 10/1960 Boettler .
5,026,204 6/1991 Kulp et al. .

FOREIGN PATENT DOCUMENTS 365567 7/1974 Sweden .

OTHER PUBLICATIONS

"Exhibitors Referenced Book" American Traffic Safety services Association Annual Trade Show and 18th Annual Convention; Mar. 1988 Exhibit E.

"Manual of Traffice Control for Construction and Maintenance Operations—Revision 14" Bureau of Traffic, State of Ohio Dept. of Transportation; Jul. 1990; pp. 7–1 through 7–4, 7–24, 7–25 Exhibit H.

*Primary Examiner*—William P. Neuder

[57] ABSTRACT

Traffic channeling device includes a deformable plastic drum and a rubber collar insertable over the drum to act as ballast for the drum. The rubber collar comprises a bead portion and an integral side wall portion of a recycled truck tire. When the rubber collar is inserted over the drum, the rubber collar gives the drum a relatively low center of gravity and grips the ground over a relatively large surface area to resist tipping of the drum and eliminate walking of the drum on the ground.

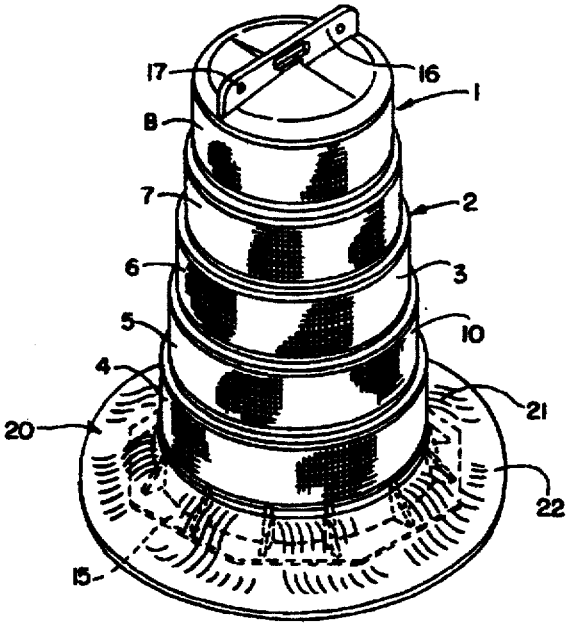

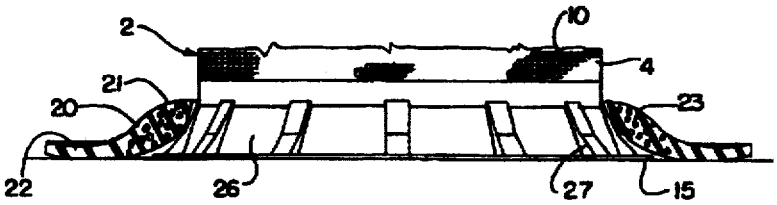

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 14, 18 and 19 is confirmed.

Claim 9 was previously cancelled.

Claims 1, 2, 3, 11, 15, 20, 23, 28 and 29 are determined to be patentable as amended.

Claims 4–8, 10, 12, 13, 16, 17, 21, 22, 24–27 and 30–32, dependent on an amended claim, are determined to be patentable.

1. A traffic channeling device comprising a deformable hollow plastic drum, and rubber collar means adapted to be inserted over said drum to act as ballast for said drum, said drum having a radially outwardly and axially downwardly tapering skirt portion adjacent a bottom edge of said drum for resisting pullout of said drum from said rubber collar means, said drum being deformable upon impact by a vehicle to cause *said drum to collapse sufficiently to permit said skirt portion to pass through said rubber collar means to dislodge* said drum [to become dislodged] from said rubber collar means leaving said rubber collar means behind.

2. The traffic channeling device of claim 1 further comprising integral flange means extending radially outwardly from *a bottom edge of* said skirt portion *around the entire periphery of said skirt portion.*

3. The traffic channeling device of claim 2 further comprising *a plurality of circumferentially spaced apart* stiffening ribs integral with said skirt portion and said flange means *around the entire periphery of said skirt portion and said flange means.*

11. A traffic channeling device comprising a deformable hollow plastic drum, and rubber collar means adapted to be inserted over said drum to act as ballast for said drum, said drum having a radially outwardly and axially downwardly tapering skirt portion adjacent a bottom edge of said drum for resisting pullout of said drum from said rubber collar means, said collar means having a loose fit on said drum to allow said drum to flex and vibrate under traffic and wind conditions without tipping over, *said drum being deformable upon impact by a vehicle to cause said drum to collapse sufficiently to permit said skirt portion to pass through said collar means to dislodge said drum from said collar means leaving said collar means behind.*

15. A traffic channeling device comprising a deformable hollow plastic drum, rubber collar means insertable over said drum to act as ballast for said drum, said rubber collar means comprising a bead portion and an integral side wall portion of a recycled truck tire, said bead portion having an inner periphery defining an opening thorugh which said drum extends, and said side wall portion extends radially outwardly and axially downwardly from said bead portion for substantial flat engagement with a surface on which said drum is placed, and means adjacent a bottom edge of said drum for resisting pullout of said drum from said rubber collar means, said drum being deformable upon impact by a vehicle to cause *said bottom edge of said drum to pass through said opening in said rubber collar means for dislodging* said drum [to become dislodged] from said rubber collar means leaving said rubber collar means behind.

20. A traffic channeling device comprising a deformable hollow plastic drum, and rubber collar means adapted to be inserted over *a top end of* said drum to act as ballast for said drum, said rubber collar means comprising a relatively rigid bead portion and a relatively non-rigid integral side wall portion of a recycled truck tire, said drum being deformable upon impact by a vehicle to cause *a bottom end of said drum to pass through said rubber collar means to dislodge* said drum [to be dislodged] from said rubber collar means leaving said rubber collar means behind.

23. A traffic channeling device comprising a deformable hollow plastic drum, and rubber collar means adapted to be inserted over *a top end of* said drum to act as ballast for said drum, said rubber collar means comprising a relatively rigid bead portion and a relatively non-rigid integral side wall portion of a recycled truck tire, said rubber collar means having a loose fit on said drum, whereby in the event said drum should tip over, said rubber collar means will move up on said drum and said side wall portion will flatten out where said side wall portion contacts said surface, making it more difficult for said drum to roll, *said drum being deformable upon impact by a vehicle to cause a bottom end of said drum to pass through said rubber collar means to dislodge said drum from said rubber collar means leaving said rubber collar means behind.*

28. A traffic channeling device comprising a deformable hollow plastic drum, and rubber collar means adapted to be inserted over said drum to act as ballast for said drum, said rubber collar means comprising a relatively rigid bead portion and a relatively non-rigid integral side wall portion of a recycled truck tire, said drum being deformable upon impact by a vehicle to cause *a bottom end of said drum to pass through said rubber collar means to dislodge* said drum [to become dislodged] from said rubber collar means, said rubber collar means having a generally ramp-like shape making it easy for a vehicle to drive over said rubber collar means without causing damage to the vehicle after said drum has been dislodged from said rubber collar means upon impact.

29. A traffic channeling device comprising a deformable hollow plastic drum, and rubber collar means adapted to be inserted over said drum to act as ballast for said drum, said drum having a projecting portion adjacent a bottom edge of said drum for resisting pullout of said drum from said rubber collar means, said drum being deformable upon impact by a vehicle to cause *said projecting portion to pass through said rubber collar means to dislodge* said drum [to become dislodged] from said rubber collar means leaving said rubber collar means behind.

* * * * *